US005502690A

United States Patent [19]

Wohlfahrt

[11] Patent Number: 5,502,690

[45] Date of Patent: Mar. 26, 1996

[54] WATCH CASE FORMED FROM A DISPOSABLE BEVERAGE CAN

[75] Inventor: Robert Wohlfahrt, Luzern, Switzerland

[73] Assignee: Crash Holding AG, Zug, Switzerland

[21] Appl. No.: 399,195

[22] Filed: Mar. 6, 1995

Related U.S. Application Data

[60] Division of Ser. No. 177,929, Jan. 6, 1994, which is a continuation-in-part of Ser. No. 946,363, Dec. 18, 1992, abandoned.

[51] Int. Cl.[6] ..... G04B 37/00

[52] U.S. Cl. ..... 368/276; 368/280

[58] Field of Search ..... 368/280, 281, 368/276; 29/179

[56] References Cited

U.S. PATENT DOCUMENTS

| | | | |
|---|---|---|---|
| 4,580,907 | 4/1986 | Cognard | 368/281 |
| 5,065,374 | 11/1991 | Soder et al. | 368/280 |
| 5,077,710 | 12/1991 | Gogniat | 368/280 |
| 5,142,512 | 8/1992 | Takano et al. | 368/232 |
| 5,173,884 | 12/1992 | O'Connell | 368/281 |

FOREIGN PATENT DOCUMENTS

| | | | |
|---|---|---|---|
| 0092510 | 10/1993 | European Pat. Off. | 368/280 |

*Primary Examiner*—Bernard Roskoski
*Attorney, Agent, or Firm*—Bachman & LaPointe

[57] ABSTRACT

The present invention relates to a process for producing casings for time pieces and, more particularly, a process for producing casings from disposable metal containers for receiving watch movements and the resulting time pieces.

4 Claims, 4 Drawing Sheets

WATCH CASE FORMED FROM A DISPOSABLE BEVERAGE CAN

This is a division of application Ser. No. 08/177,929, filed Jan. 6, 1994 which is a continuation-in-part of U.S. patent application Ser. No. 946,363 filed Dec. 18, 1992 now abandoned.

BACKGROUND OF THE INVENTION

The present invention is drawn to a process for producing a casing for receiving a watch movement and the resulting time piece.

It is known to produce time pieces wherein a casing formed with a cavity has a watch movement located therein. The time pieces may be in the form of wrist watches, pocket watches, all types of clocks and the like.

In today's environmentally conscience society it has become highly desirable to find new uses for spent commodities. By making useful products out of spent commodities, environmental pollution can be reduced.

Accordingly, it is the principal object of the present invention to provide a process for forming a casing for a time piece out of spent metallic material.

It is a further object of the present invention to provide a process as aforesaid for forming time piece casings out of disposable metal containers such as beverage cans.

It is a still further object of the present invention to provide a time piece in the form of a wrist watch, pocket watch, clock and the like which employs a casing formed from disposed metal containers.

Further objects and advantages of the present invention will appear hereinbelow.

SUMMARY OF THE INVENTION

The present invention relates to a process for producing casings for time pieces and, more particularly, a process for producing casings from disposable metal containers for receiving watch movements and the resulting time pieces.

The process of the present invention is drawn to a process for producing a casing for receiving a watch movement. In accordance with one embodiment of the process of the present invention, a disposable empty metal container, particularly an empty beverage can, having a substantially cylindrical sidewall about a longitudinal axis, a bottom and a cover, is compressed, preferably longitudinally, to produce a compressed multi-layered metal piece of predetermined dimension. Thereafter a cavity is formed in the compressed metal piece for receiving the watch movement. In an alternative process, the bottom and cover are removed from the container to form an open-ended substantially cylindrical blank which is slit through its sidewall longitudinally. The blank is thereafter positioned into a die and compressed to produce a ring-shaped casing consisting of the compressed multi-layered metal piece. The ring piece is thereafter closed off with a closure member to form the casing for receiving the watch movement. In a third embodiment of the present invention the disposable beverage container having the top and bottom removed therefrom is compressed so as to produce a multi-layered metal sheet. The multi-layered sheet is thereafter formed into a ring-shaped casing wall in a multiple step operation and closed off by a closure member.

The present invention is also drawn to a time piece comprising a watch casing formed of a compressed disposable beverage can, beverage can indicia visible on a surface of the watch casing and a watch movement positioned in said watch casing.

BRIEF DESCRIPTION

DETAILED DESCRIPTION

The present invention relates to a process for forming a watch casing for use in the manufacture of a time piece and the resulting time piece.

Figure 1:
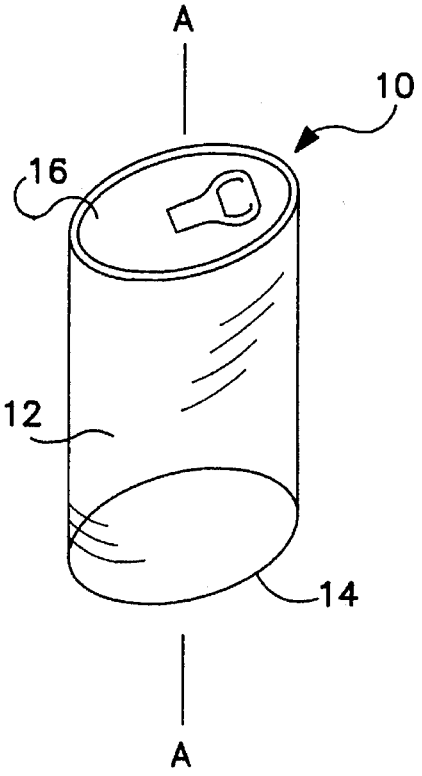
FIGS. 1–3 illustrate a first embodiment of a process in accordance with the present invention for producing a casing for receiving a watch movement.
Figure 2:
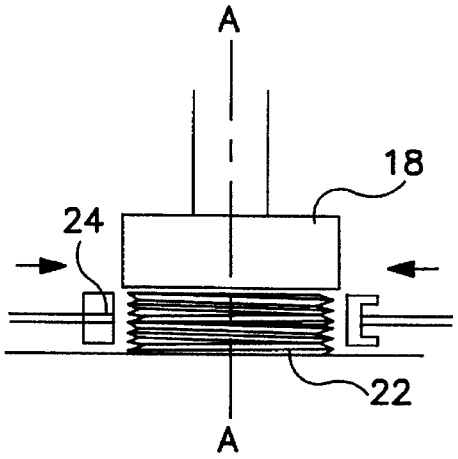
Figure 3:
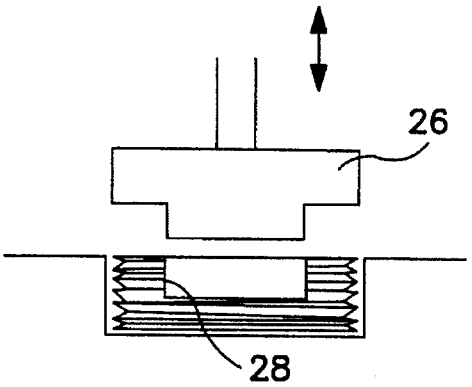

FIGS. 1–3 illustrate a first embodiment of a process in accordance with the present invention. With reference to FIGS. 1–3, a disposable empty metal container 10 comprises a substantially cylindrical sidewall 12 about a longitudinal axis A, a bottom wall 14 and a cover 16. In accordance with the process of the present invention a press ram 18 compresses the substantially cylindrical container 10 along the longitudinal axis thereof so as to produce a compressed multi-layered metal piece of predetermined dimension 22. The dimension of the compressed metal piece is determined by a die 24 having the predetermined shape and height which is desirable for the resulting multi-layered metal piece 22.

Figure 4:
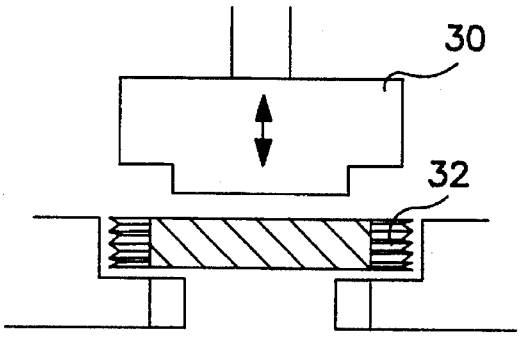
FIGS. 4 and 5 illustrate a second embodiment of a process in accordance with the present invention for producing a casing for receiving a watch movement.
Figure 5:
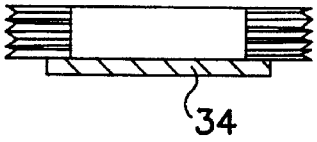
Figure 6:
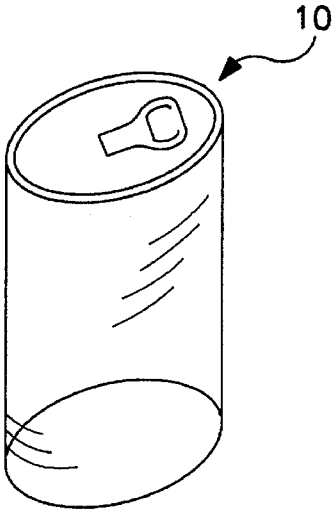
FIGS. 6–12 illustrate a third embodiment of a process in accordance with the present invention for producing a casing for receiving a watch movement.
Figure 7:
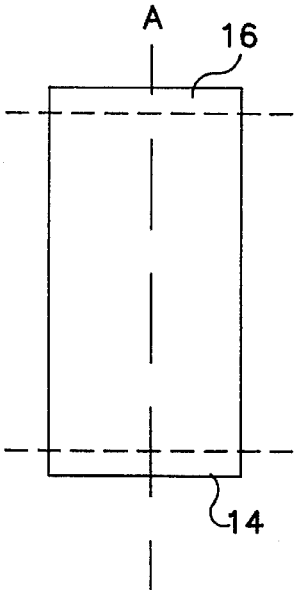
Figure 8:
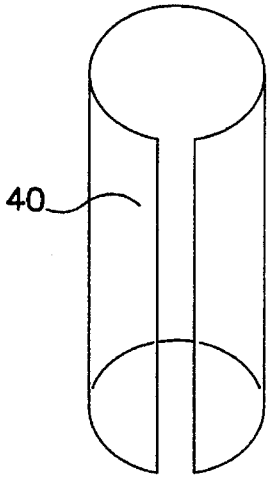
Figure 9:
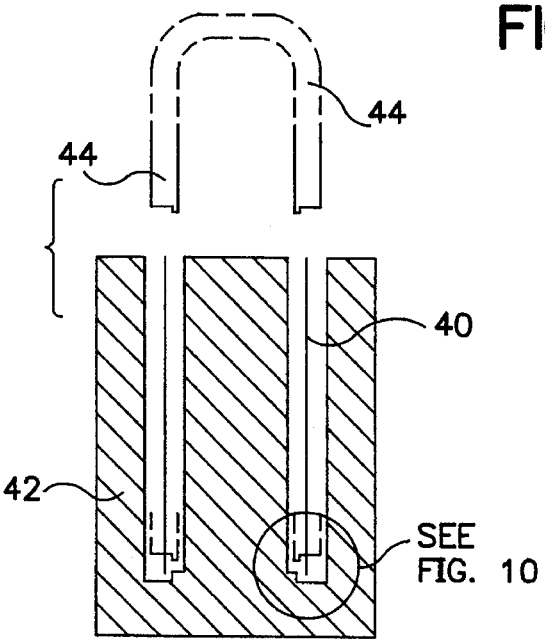
Figure 10:
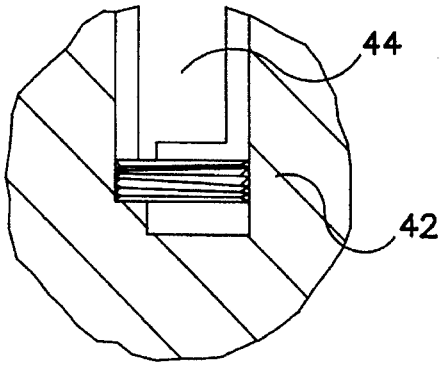
Figure 11:
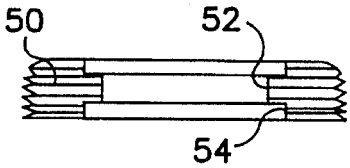

With reference to FIG. 3, the multi-layered compressed metal piece is thereafter punched with a second ram 26 so as to form a cavity 28 of desired shape for receiving a watch movement (not shown) for forming a time piece. FIGS. 4 and 5 illustrate an alternative operation in accordance with the process of the present invention wherein the compressed multi-layer metal piece is punched with ram 30 so as to form a ring-like member 32 which thereafter has one side closed off by a closure member 34 in any suitable manner such as welding, gluing, or the like.

Figure 12:
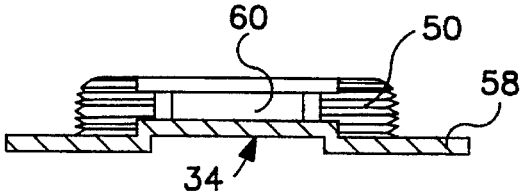
Figure 13:
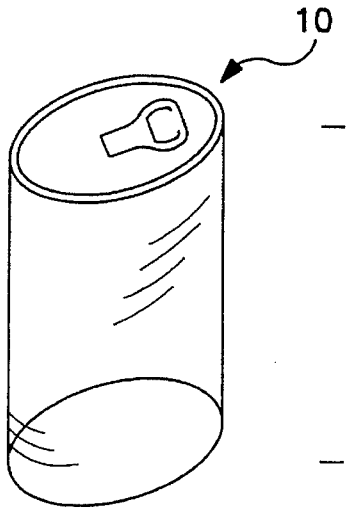
FIG. 13–18 illustrate a fourth embodiment of a process in accordance with the present invention for producing a casing for receiving a watch movement.
Figure 14:
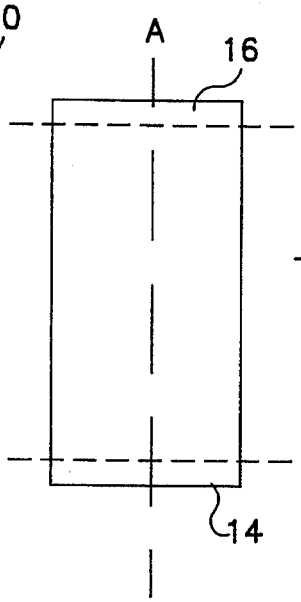
Figure 15:
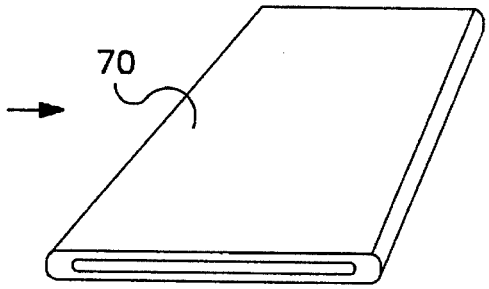

FIGS. 6–12 illustrate a second embodiment of the process of the present invention. In the second embodiment a substantially cylindrical container 10 of the type described above with regard to FIG. 1 is subjected to a cutting operation as illustrated schematically in FIG. 7 for removing the bottom 14 and cover 16 from the container to form an open-ended cylindrical blank 40. The cylindrical sidewall of the blank is thereafter slit longitudinally and the blank is loaded into a ring-shaped die 42, shown in FIG. 9 where the material is compressed by a ram 44 so as to form a ring-shaped multi-layered metal piece. The die 42 and ram 44 may be shaped (see FIG. 10) so as to give a desired shaped ring blank 50 having a first cavity 52 for receiving a watch movement 60 and a second cavity 54 for receiving a closure plate 56 which, as shown in FIG. 12 may also include flanges 58 for receiving a wrist band.

Figure 16:
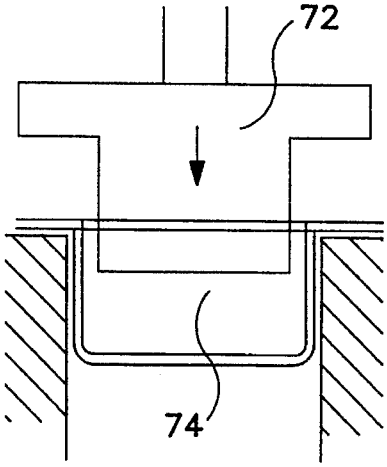
Figure 17:
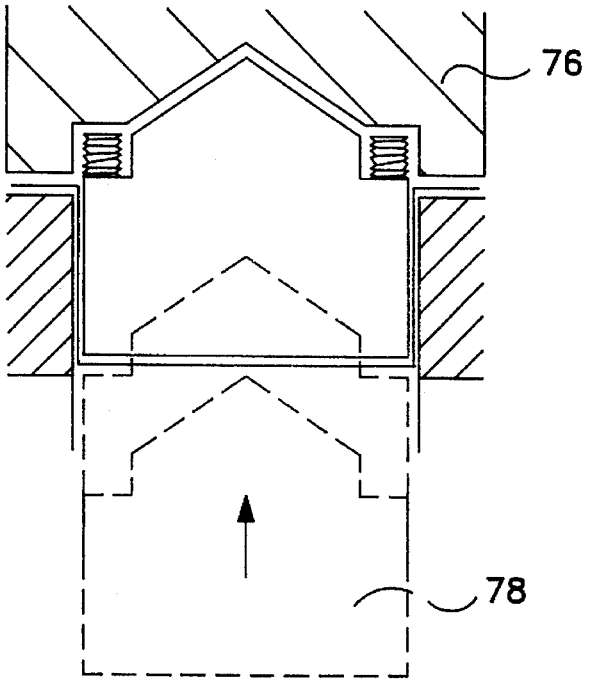
Figure 18:
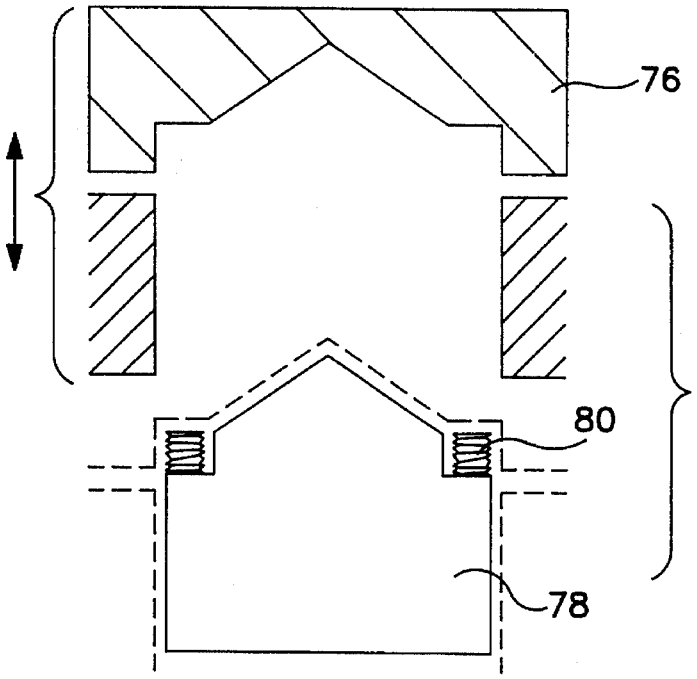

FIGS. 13–18 show a further alternative process in accordance with the present invention wherein the cylindrical container 10 having the cover 16 and bottom 14 removed therefrom is compressed radially so as to form a multi-layered metal sheet 70. The multi-layered metal sheet 70 is thereafter punched with ram 72 as shown in FIG. 16 so as to form a cavity 74. A shaping die 76 is thereafter provided, as shown in FIG. 17, and a further ram 78 which mates with the shaping die 76 forms the material into a ring-shaped casing wall 80. A closure member may then be applied to the ring-shaped wall for forming the casing for receiving a watch movement.

In a preferred embodiment of the present invention the disposable empty metal container is in the form of a beverage can. When processing a beverage can in accordance with the process of the present invention for making a watch casing, the resulting watch casing has the beverage can indicia visible on the surface thereof. The random indicia on the surface of the watch casing offers an attractive, colorful watch casing. A watch movement may be received in the watch casing for forming a time piece.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A timepiece having a watch casing formed by compressing a disposable metal beverage can bearing indicia comprising: a metal watch casing having a sidewall portion having an inner surface defining an opening for receiving means for displaying time and an outer circumferential surface, said sidewall portion comprises multi-layer folds of metal bearing random indicia on the outer circumferential surface; and means for displaying time mounted in said opening.

2. A timepiece comprising: a metal watch casing having a sidewall portion having an inner surface defining an opening for receiving means for displaying time and an outer circumferential surface, said sidewall portion comprises multi-layer folds of metal bearing random indicia on the outer circumferential surface; and means for displaying time mounted in said opening.

3. A timepiece having a watch casing formed by compressing a disposable metal beverage can bearing indicia comprising: a metal watch casing having a sidewall portion having an inner surface defining an opening for receiving means for displaying time and an outer circumferential surface, said sidewall portion comprises crushed metal randomly bearing at least a portion of said indicia on the outer circumferential surface; and means for displaying time mounted in said opening.

4. A timepiece comprising: a metal watch casing having a sidewall portion having an inner surface defining an opening for receiving means for displaying time and an outer circumferential surface, said sidewall portion comprises crushed metal bearing random indicia on the outer circumferential surface, said sidewall portion being formed from a compressed disposable metal can bearing said indicia; and means for displaying time mounted in said opening.

* * * * *